US010577932B2

(12) United States Patent
Lavoie et al.

(10) Patent No.: US 10,577,932 B2
(45) Date of Patent: Mar. 3, 2020

(54) BARRICADE WALL

(71) Applicant: DKR Manufacturing Inc., Noëlville (CA)

(72) Inventors: Roland Lavoie, Noëlville (CA); Patrick Timony, Noëlville (CA)

(73) Assignee: DKR MANUFACTURING INC., Noelville (CA)

( * ) Notice: Subject to any disclaimer, the term of this patent is extended or adjusted under 35 U.S.C. 154(b) by 0 days.

(21) Appl. No.: 15/993,345

(22) Filed: May 30, 2018

(65) Prior Publication Data

US 2018/0347360 A1 Dec. 6, 2018

Related U.S. Application Data

(60) Provisional application No. 62/512,414, filed on May 30, 2017.

(51) Int. Cl.
*E21F 15/04* (2006.01)
*E21F 17/103* (2006.01)
*E21F 1/14* (2006.01)

(52) U.S. Cl.
CPC ..... *E21F 15/04* (2013.01); *E21F 1/14* (2013.01); *E21F 17/103* (2013.01)

(58) Field of Classification Search
CPC ..... E21F 17/103; E21F 15/04; E21D 11/102
USPC ..... 405/132, 150.2, 151, 152; 454/169, 170
See application file for complete search history.

(56) References Cited

U.S. PATENT DOCUMENTS 1,478,303 A * 12/1923 Snyder ..... E21F 17/103 299/12
3,302,343 A * 2/1967 Bear ..... E21F 17/103 405/132
3,638,754 A * 2/1972 Sosnowicz ..... E21F 17/103 181/211
6,450,735 B1 * 9/2002 Mills ..... E21F 17/103 405/150.2
9,797,250 B1 * 10/2017 Akers ..... E21F 11/00
2013/0143942 A1 * 6/2013 Slater ..... A01N 47/06 514/409
2018/0094524 A1 * 4/2018 Lamond ..... E21F 15/02

FOREIGN PATENT DOCUMENTS

CA 2753091 A1 3/2013

* cited by examiner

*Primary Examiner* — Carib A Oquendo
(74) *Attorney, Agent, or Firm* — Ridout & Maybee LLP

(57) ABSTRACT

A barricade wall is provided that is easily and rapidly customizable in a mine depending on the requirements of the particularly open area. The barricade wall can be customizable depending on the size and spatial requirements of a particular open area in a mine. Further, the top beams of the barricade wall can be elongated or shortened, depending on the requirements of the open area in the mine. The barricade wall has a first rigid wall section with spring loaded wall extensions attached to the wall section.

18 Claims, 12 Drawing Sheets

BARRICADE WALL

RELATED APPLICATION

This application claims the benefit of and priority to U.S. Provisional Patent Application No. 62/512,414, filed May 30, 2017, the contents of which are incorporated herein by reference.

FIELD

The field relates generally to a barricade wall and method of assembling and installing barricade walls in mines and other locations.

BACKGROUND

A common practice in underground mines is the construction of concrete bulkheads or barricades. Such barricades may for example entail the construction of a wall that is then covered with shotcrete. These barricade may, for example, be erected in a drift tunnel to contain pastefill (or sandfill) used in the backfilling process of previously mined out areas. This is done in order to maintain ground stability to the surrounding mining areas and prevent debris from entering the surrounding mining areas. As the entrances to the open areas are uniquely different and dangerous, due to falling rocks, it is necessary to custom construct these bulkheads from a safe distance. In one example, once an area has been mined, a barricade is erected to block passageway or drift that accesses a mined out area The dimensions of passageways such as drift tunnels in mines are uniquely different, and it is necessary for a constructed barricade to fit within the passageway.

SUMMARY

In various examples disclosed herein, the present disclosure describes a barricade wall that can be built to be compact and that expands when positioned in a preferred location in a mine. The barricade wall further comprises a support beam assembly that can be elongated or shortened as required, and that can be safely installed from a distance. The barricade wall additionally comprises an anchor member for providing additional anchor support to connect the barricade wall to the ceiling of the mine.

In one example aspect there is provided a barricade wall assembly comprising a wall structure including: a central rigid wall section; at least one wall extender located at an edge of the rigid wall section, the wall extender being movable between a retracted position in which a dimension of the wall structure is reduced and an extended position in which the dimension of the wall structure is increased.

Methods of assembling and installing the wall are also provided.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION OF EXAMPLE EMBODIMENTS

The dimensions of open passageways such as drift tunnels in mines can be uniquely different depending on the particular passageway. The size and shape of a barricade must be constructed to fit within the passageway. It is beneficial to custom construct a barricade to fit a particular entrance, and it is further advantageous to be able to alter the dimensions of a barricade or barricade wall directly in a mine.

Additionally, in order to position a barricade wall at a preferred location in a mine, it may be necessary to move a pre-assembled, uninstalled barricade wall through the mine. If a barricade wall is too large, it will not be able to pass to the preferred location. In other words, if the barricade wall is larger than the dimensions of the drift tunnel of the mine, or if the barricade wall is similar in size to the dimensions of the drift tunnel, the barricade wall could get caught on the sides or top of the drift tunnel as it is moved into location.

Further, holes used to attach the barricade wall to the ceiling of the drift tunnel via poles are predrilled and attachment elements are inserted into the ceiling prior to installation of a barricade wall, and it is advantageous for poles of a barricade wall to be customizable depending on the required length of the poles to attachment elements.

Figure 1:
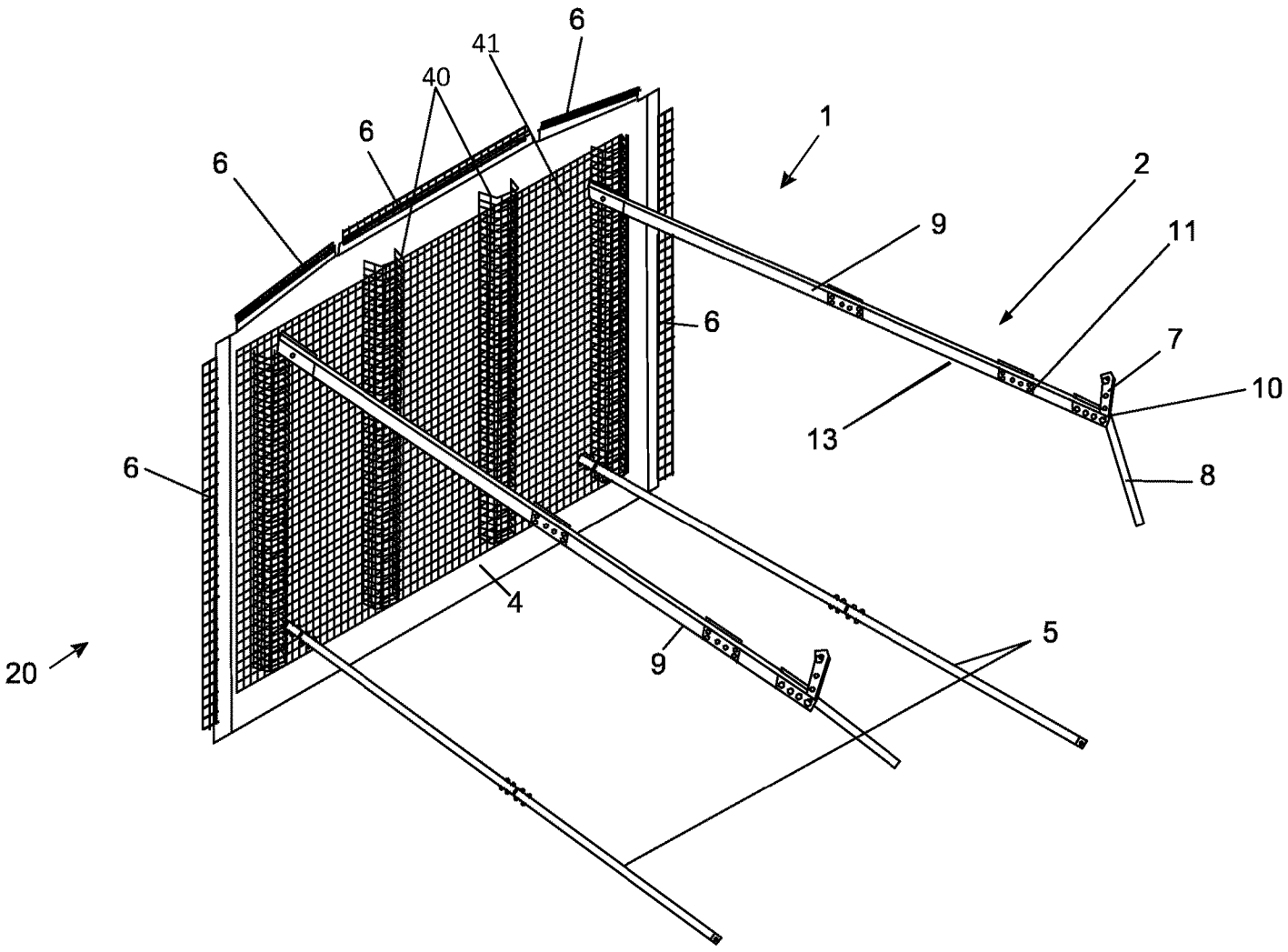
FIG. 1 is a perspective side view of an embodiment of the barricade wall assembly.

Referring to FIG. 1, the present disclosure provides a bulkhead in the form of a barricade wall assembly 1 that is easily and rapidly customizable and that can safely and securely be assembled in the mine to barricade open areas such as a drift tunnel depending on the requirements of the particular area.

Barricade wall assembly 1 can be customizable depending on the size and spatial requirements of a particular passageway that it is intended to block. Further, top beams assembly 2 of barricade wall assembly 1 can be elongated or shortened, depending on the requirements of the drilled holes in the ceiling of the passageway.

Expandable Wall

The customizability of the dimensions of barricade wall assembly 1 and the ability to increase or decrease the size of the dimensions of barricade wall assembly 1 is disclosed herein in further detail.

Referring to FIGS. 1 to 5, 7, and 8 the barricade wall assembly 1 includes an expandable wall structure 20 that is configured to extend across a passageway at a location where the passageway is to be blocked. Wall structure 20 includes a central rigid wall section 4 that has spring loaded wall extensions 6 secured to its periphery. In the illustrated embodiment, wall extensions 6 are secured by spring loaded devices such as spring loaded hinges 3 (as shown for example, in FIGS. 7 and 8) to one or more peripheral edges of the of central rigid wall section 4. Central rigid wall section 4 is constructed to have smaller dimensions than the passageway opening that wall structure 20 will be used to barricade in order to facilitate installation of barricade wall structure 20 at its desired location across the passageway.

Figure 2:
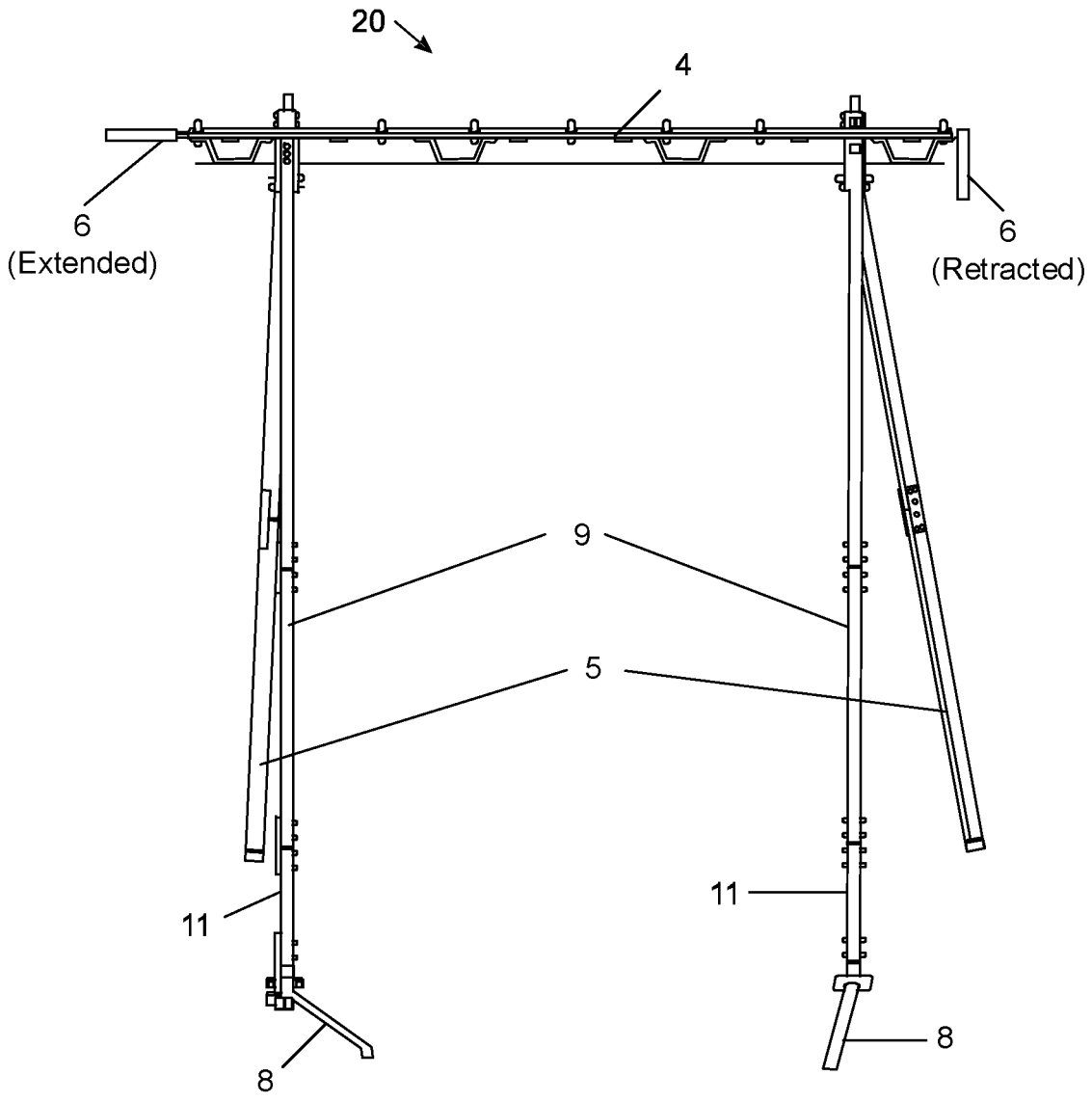
FIG. 2 is a top view of an embodiment of the barricade wall assembly shown in FIG. 1.
Figure 3:
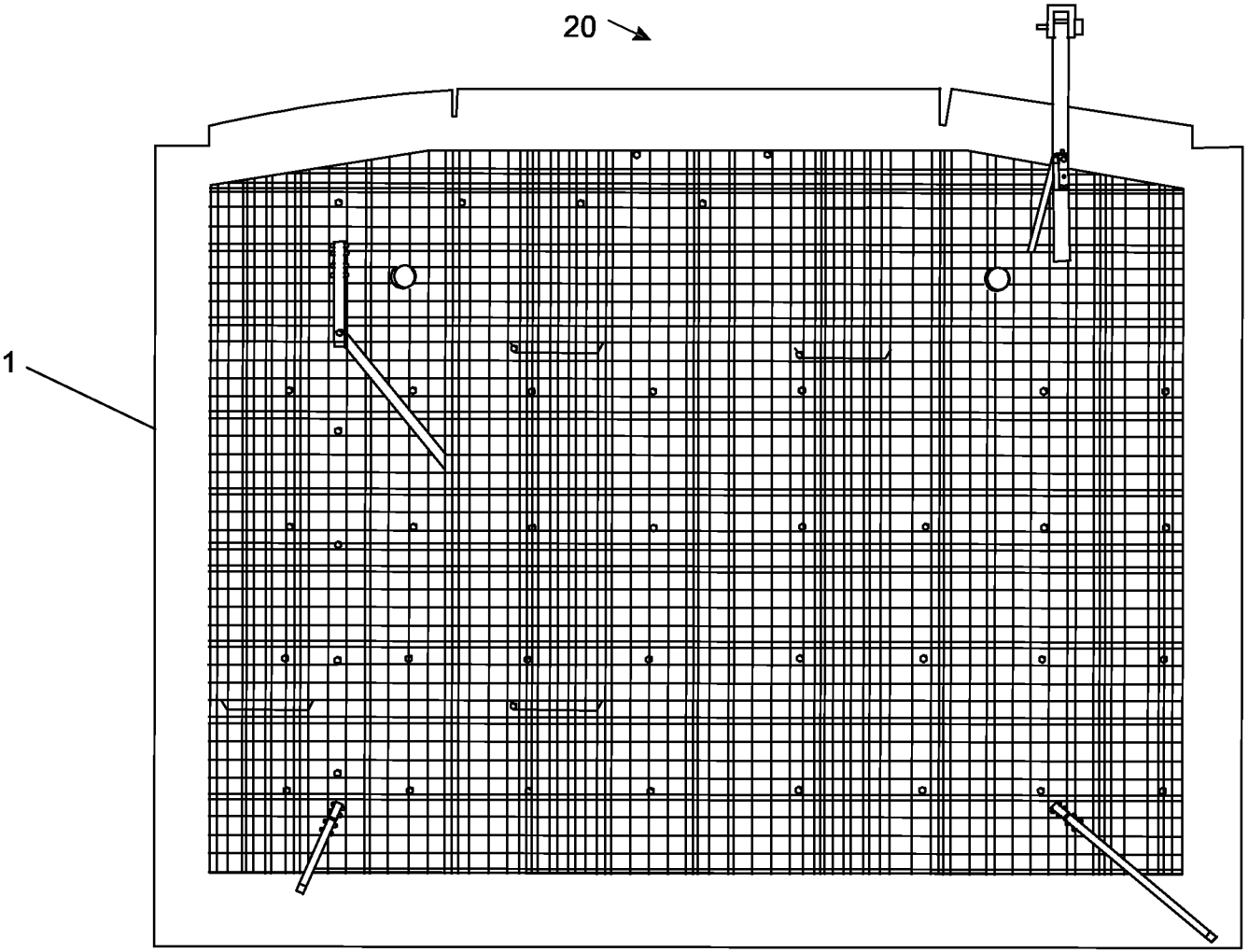
FIG. 3 is a front view of an embodiment of the barricade wall assembly shown in FIGS. 1-2.
Figure 4:
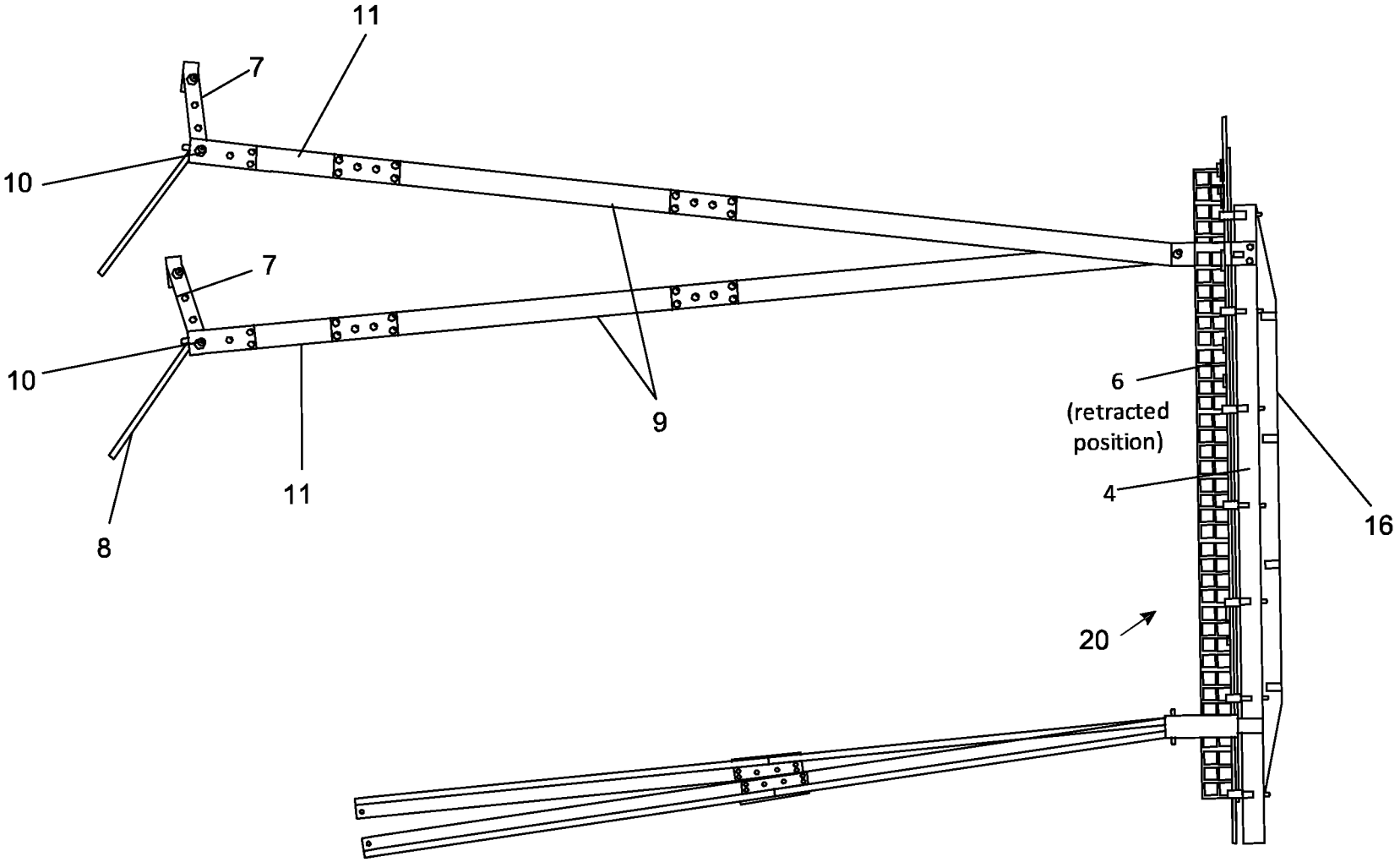
FIG. 4 is a side view of an embodiment of the barricade wall assembly shown in FIGS. 1-3.

Wall extensions 6 are configured to be movable from a first (retracted) position to a second (extended) position in order to increase the size of the wall structure 20. In example embodiments, when in the retracted position, the wall extensions 6 are folded so that they are substantially perpendicular to the central rigid wall section 4, and in the extended position the wall extensions 6 each extend outward from the periphery of the central rigid wall section 4 in a plane that is generally to parallel to the central rigid wall section 4. In example embodiments, spring loaded wall extensions 6 are released after the barricade wall assembly 1 is positioned into its intended location in a passageway to cause the wall extensions 6 to move from their retracted installation positions to their extended positions. In their extended positions, the wall extensions 6 extend to cover areas of a passageway (such as a drift tunnel opening) around the periphery of central rigid wall section 4. The wall extensions 6 thus increase the effective size of the wall structure 20 about the central rigid wall section 4. In this regard, FIGS. 1, 3, 7 and 8 show the wall extensions 6 in their extended positions and FIG. 4 shows a wall extension 6 in its retracted (e.g. folded) position, and the top view of FIG. 2 shows one wall extension 6 in an extended position and one wall extension 6 in a retracted position.

As disclosed in FIGS. 1 to 5 and 7, in an example embodiment, wall extensions 6 are attached to a top edge portion of rigid wall section 4 and along the opposite vertically extending side edge portions of wall section 4. Other attachment configurations of wall extensions 6 are also possible—for example, they may be omitted from one side of wall section 4 in some examples, and may be included on the bottom edge wall of wall section 4 in some examples.

Figure 7:
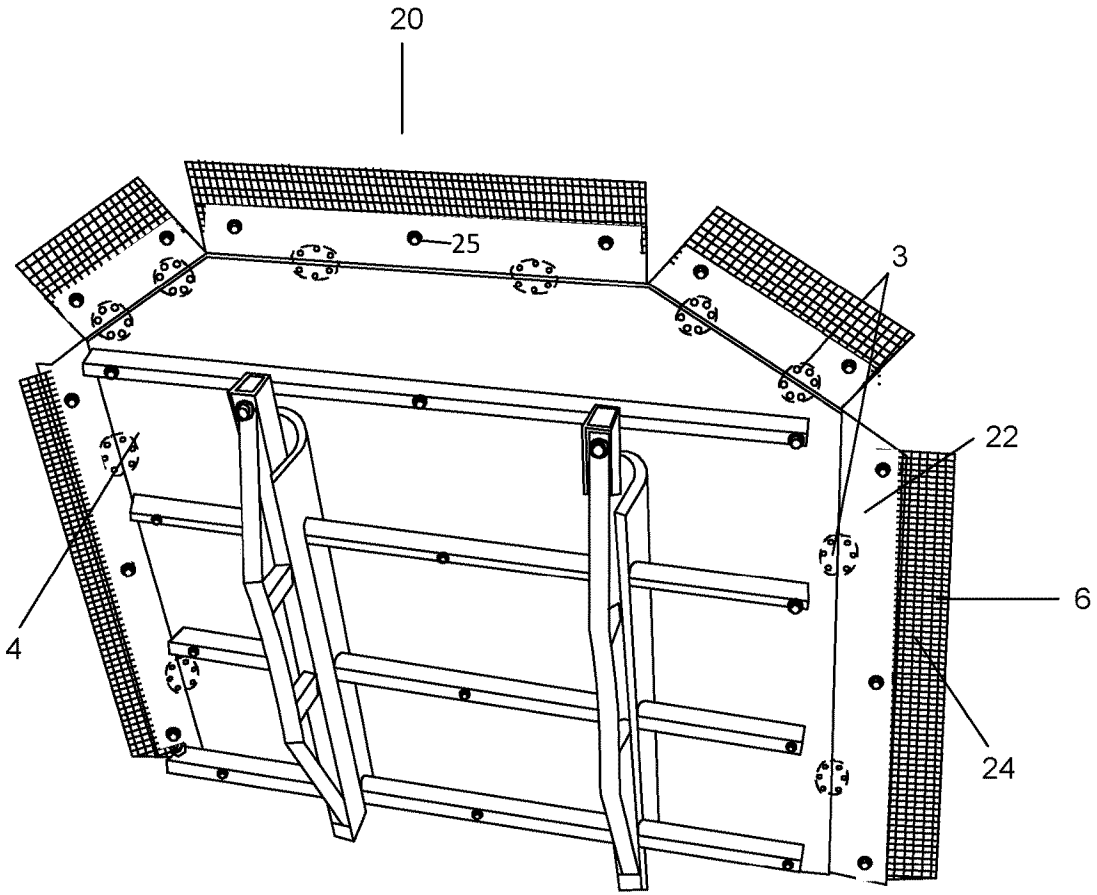
FIG. 7 is a perspective back view of the barricade wall assembly of FIG. 1.
Figure 8:
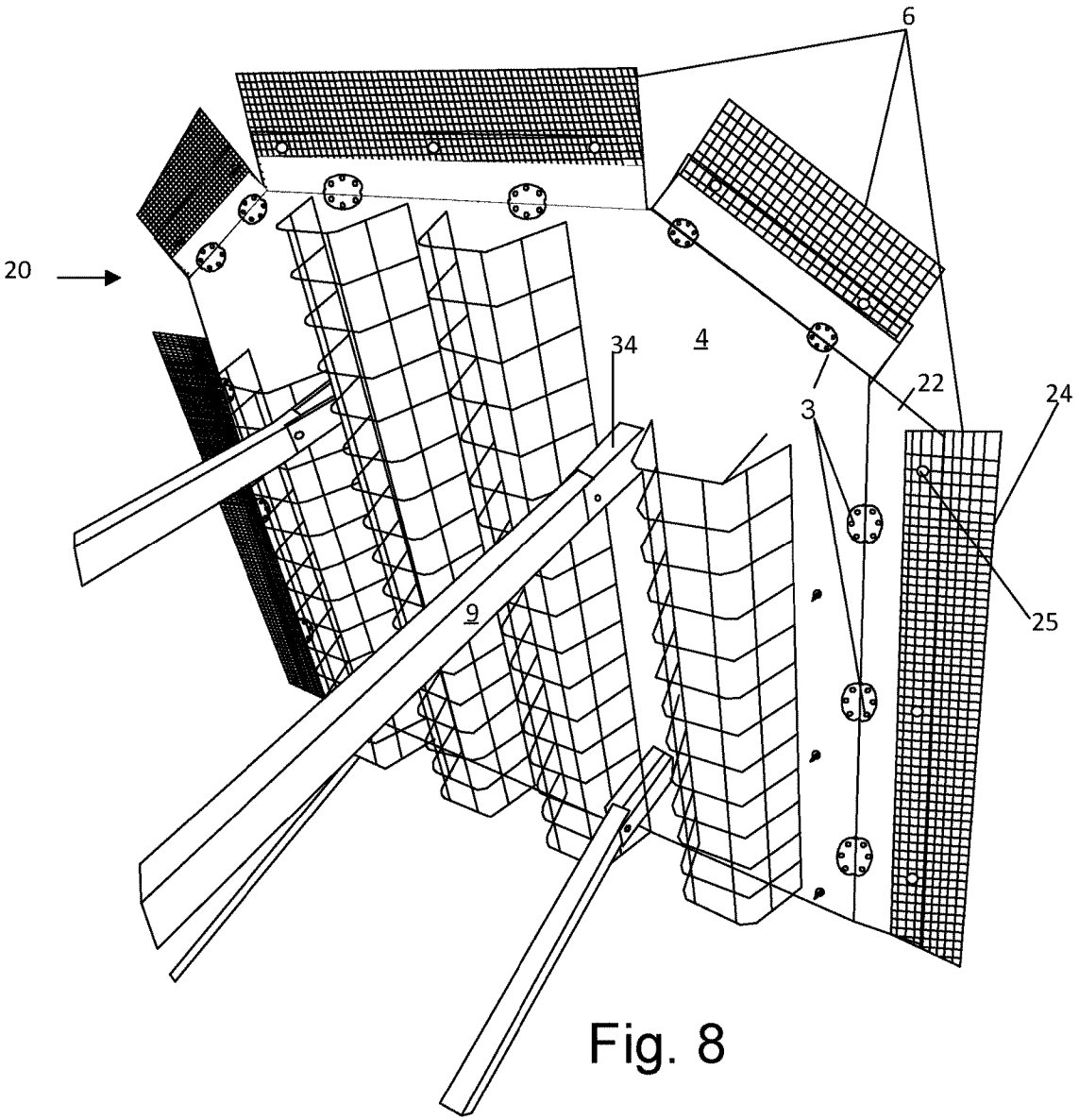
FIG. 8 is a perspective front view of the barricade wall assembly of FIG. 1.

As seen in FIGS. 7 and 8, in example embodiments at least two spring loaded hinges 3 are used for each wall extension 6, and the spring loaded hinges 3 are biased towards an 180 degree open position between the hinge halves.

Figure 6:
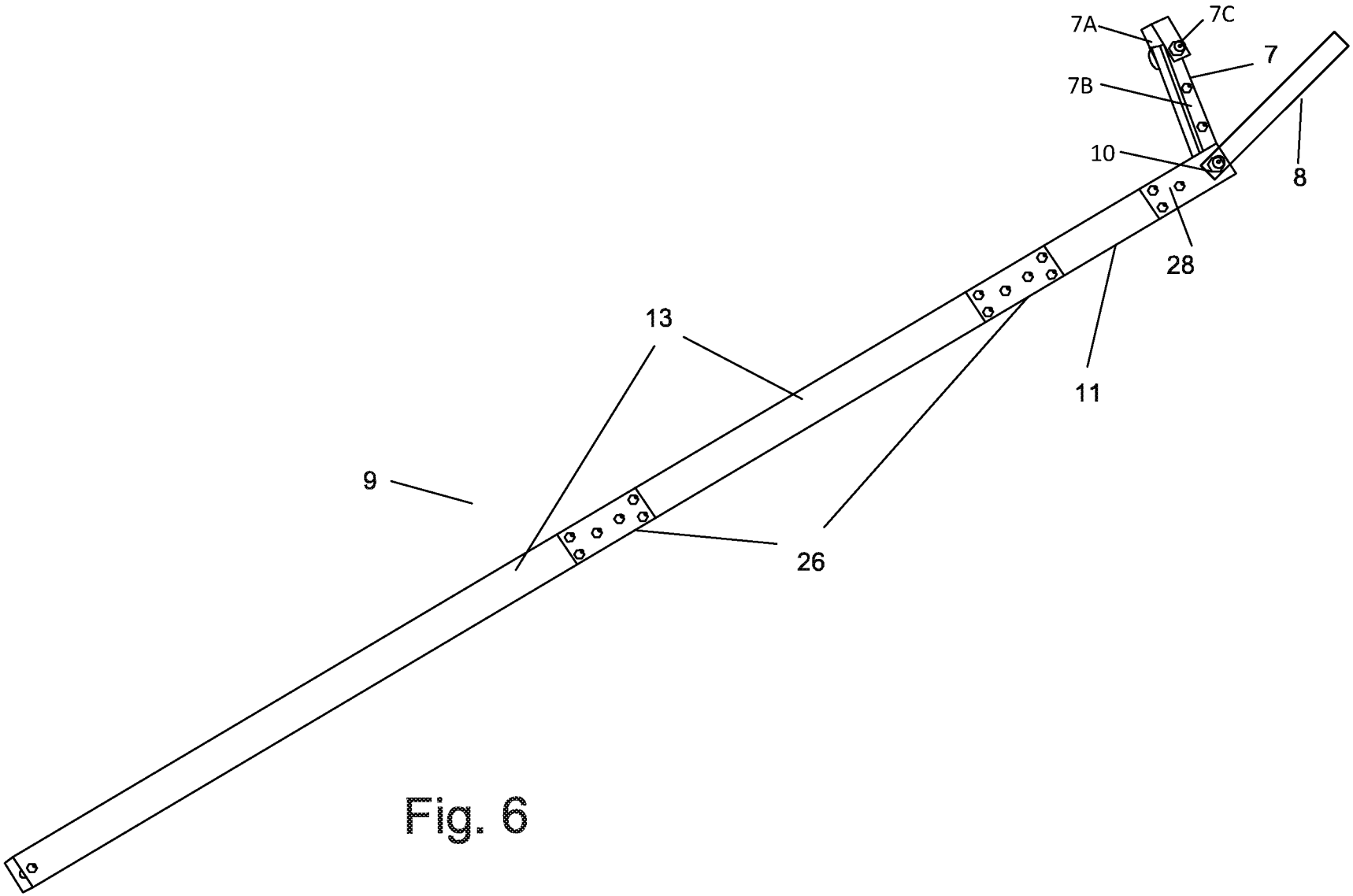
FIG. 6 is perspective view of an upper beam of the barricade wall assembly of FIG. 1.

Referring to FIGS. 6 and 7, in example embodiments, wall extensions 6 each comprise a rigid section 22 (for example a plywood section) that one or more spring loaded hinges 3 are attached to, and a mesh section 24 extending outward from the rigid section 22. The mesh section 24 may, in various embodiments, be a semi-rigid or flexible or rigid wire mesh or a cloth mesh that is capable of supporting a layer of wet shotcrete. The wire mesh section 24 of each wall extension 6 is secured by bolts to its corresponding rigid section 22. In some examples, the rigid section 22 may have a width of 2 to 6 inches, and the wire mesh 24 may extend a further 2 to 6 inches beyond the rigid section, providing a wall extension 6 of between 4 to 12 inches in width.

Wall structure 4 may comprise plywood or other kinds of suitable wood material.

The shape of central wall section 4 and overall wall structure 20 may be triangular, square, rectangular, hexagonal, or any other shape, including irregular shapes as required by the cross-sectional area of the passageway that the barricade wall structure 20 is designed to close. The shape may be customized according to the specific shape of the opening to be barricaded.

In one example embodiment, the barricade wall structure 20 can be configured to barricade an opening that is 15 feet wide and 20 feet tall. In another example embodiment, barricade wall structure 20 can be dimensioned for a 15 feet wide and 15 feet tall opening. In another example embodiment, barricade wall structure 20 can be dimensioned for a 30 feet wide and 15 feet tall opening. Other dimensions are possible. The example embodiments provided are not meant to be limiting.

Adjustable Beams

As shown in FIG. 1-4, the barricade wall assembly 1 includes a support beam assembly 2 that includes removable beams 5, 9 that are used to move the wall structure 20 into place and secure it until shotcrete is applied and set. The removable beams include a pair of lower beams 5 and a pair of adjustable upper beams 9 that are each pivotally attached at one end to the wall structure 20. The adjustable upper beams 9 are used to secure barricade wall structure 20 to the ceiling of a mine passage to maintain barricade wall structure 20 in place. In this regard, the extending ends of upper beams 9 are each releasably connected to a respective mounting bracket 7 that is configured to be secured to the mine passageway ceiling or wall as disclosed further below.

The bottom beams 5 function as braces and are configured to be secured to the side walls or floor of the mine passageway.

In an example embodiment, upper beams 9 are configured to have an adjustable length allowing the beams 9 to be customized on the installation spot in the mine. This may be beneficial in situations where predrilled holes in the passageway ceiling or walls for the mounting brackets 7 are not ideally located. As shown for example in FIGS. 2 and 4, an adjusting arm 8 is also provided on the extending end of each upper beam 9. Adjusting arm 8 is also secured to the ceiling of the mine. A pin member 10 (which may be a bolt for example) connects adjusting arm 8 to beam member 9 allowing for adjusting arm 8 to pivot about pin member 10.

As shown in FIG. 6, in some example embodiments each upper beam 9 includes at least two elongate beam sections 13 that are rigidly secured together with bolts through an intermediate bracket 26. Each upper beam also includes an adjustment beam section 11 that is rigidly secured to the end of one of the elongate beam sections 13 by a further intermediate bracket 26. A terminating bracket 28 is rigidly secured at the end adjustment beam section 28, and the mounting bracket 7 is pivotally secured by pin 10 (which could be a bolt) to the terminating bracket 28. As shown in FIG. 6, adjusting arm 8 is also pivotally secured to the terminating bracket 28. The lengths of the elongate arm sections 13 are selected to allow the barricade wall assembly 1 to be transported to an in-mine installation site in a broken down state. For example, elongate beam sections 13 may each be 10 to 12 feet in length. Adjustment beam section 11 is shorter in length than elongate beam sections 13 and can be removed entirely from the beam 9 (terminal bracket 28 can be secured directly to a beam section 13) or swapped out for a shorter or longer beam section 11 to adjust the length of beam 9 at the installation site. Accordingly, adjustment beam section 11 allows for an upper beam 9 beam to be increased or decreased according to the length required by the holes in the ceiling of the mine passageway. Since the holes in the ceiling of the mine are predrilled in some applications, adjustment beam section member 11 can be inserted or removed or swapped as required in order for the beam 9 to connect to the ceiling.

Adjustment beam section 11 may be 3 feet in length, but can be longer or shorter, and multiple beams of different lengths may be included as part of an installation kit for the wall assembly 1.

In some examples, the same pin 10 may be used to connect both adjusting arm 8 and the mounting bracket 7 to the beam terminal bracket 28. Pin member 10 provides a pivot point, and once the terminal bracket is secured to mounting bracket 7, which in turn is secured to a passageway surface, adjusting arm 8 can be manipulated to adjust the angle between mounting bracket 7 and the upper beam 9 and thereby fine tune the effective length of the upper beam 9. In some examples, adjusting arm 8 is also secured to the ceiling of the mine passageway rearward of the mounting bracket, and may include a length adjustment mechanism (for example a tie-rod screw configuration or a screw tensioner) for length adjustment. In some examples the adjusting arm 8 is independently attached by a separate mounting pin to terminal bracket 28. In some examples, each mounting bracket 7 is configured to pivot relative to the ceiling, and in this regard each mounting bracket 7 includes an upper bracket portion 7A that is bolted directly to the tunnel ceiling, and a lower bracket portion 7B that is pivotally secured to the upper bracket portion 7A by a pin or bolt 7C.

Although upper beams 9 are shown as being pivotally mounted to the wall structure 20 so they can pivot up to secure to ceiling mounted mounting brackets 7, in some examples the beams 9 may also be able to pivot laterally and be secured to sidewall-mounted brackets. Furthermore, mounting brackets and adjustment sections and adjustment arms can also be provided on lower beams 5. Although pairs of upper and lower beams are shown, additional upper and lower beams 9, 5 can be provided on wider or taller wall structures 20 as required.

Installation and Assembly

Installation and assembly of barricade wall assembly 1 will now be disclosed in further detail.

In example embodiments, the dimensions of the area or opening that the wall structure 20 will be used to block are collected, for example, by scanning the perimeter of a mine drift at the intended barricade wall location using a laser enabled measuring device. Central rigid wall section 4 of barricade wall assembly 1 is then custom designed to be smaller than the measured opening, and the location and dimensions of wall extensions 6 selected to make up the difference.

In example embodiments, the components of barricade wall assembly 1 are manufactured to custom measured specifications, and the components are then transported to the installation site. For example, the components may be packed for transport on a conventional skid. In an example embodiment, the components of wall structure 20 are transported to a prescribed distance from the mine drift opening where the barricade wall will be installed and then assembled. By way of example, the prescribed distance could be 21 feet from the intended location of the barricade wall structure 20.

Figure 5:
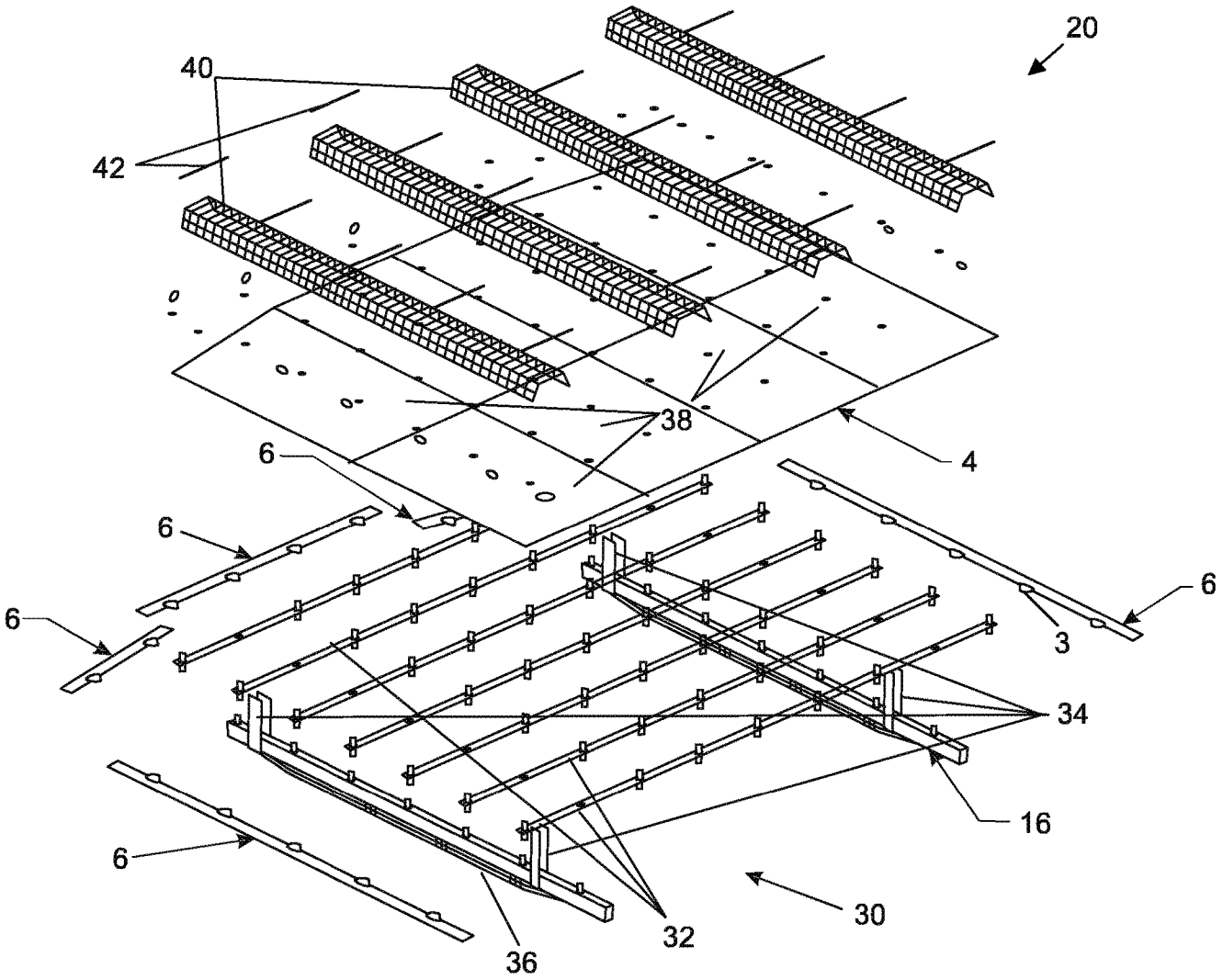
FIG. 5 is an exploded perspective side view of a barricade wall structure of the barricade wall assembly of FIG. 1.

Assembly of the components that make up wall structure 20 will now be described with reference to FIG. 5. Wall structure 20 includes a base frame 20 that is used support the central rigid wall section 4. Base frame 20 includes at least two vertical support beams 16. During assembly, vertical support beams 16 are laid down on a horizontal support surface (for example the drift tunnel floor), and a series of parallel horizontal cross braces 32 are secured to a front surface of the support beams 16. In example embodiments, skid rails 36 may extend along a back surface of the support beams 16 to facilitate sliding of the wall structure 20 into location once the wall structure 20 is assembled. As shown in FIG. 5, beam brackets 34 are provided on support beams 16 for pivotally connecting the upper and lower beams 5,9 to the wall structure 20 once it is assembled.

Central rigid wall section 4 is assembled from a plurality of rigid panels 38 (for example plywood panels) that are secured to bolts that extend from the horizontal cross braces 32 through pre-drilled holes in the panels 38. In the illustrated embodiment, eight panels 38 are used to form wall section 4, however the number of panels 38 will vary depending on wall size and configuration. In the illustrated embodiment, vertically extending mesh cage structures 40 are secured by brackets 42 to a front of the wall section 4. Cage structures 40 are provided to support shotcrete that will be sprayed on the wall structure 20 once it is installed in place. Although not shown in FIG. 5, as shown in FIG. 1, in example embodiments a further layer of mesh 41 is placed over and secured to the cage structures 40 to provide a structure for wet concrete to adhere to while it dries.

Referring again to FIG. 5, wall extensions 6 (mesh extensions 24 are not shown in FIG. 5) are secured by spring loaded hinges 3 to the outer edges of the outer panels 38 of the wall structure 4. In the illustrated embodiment, three wall extensions 6 are secured along a top edge of the wall section 4 to accommodate a pre-measured non-flat ceiling profile, and a further wall extender 6 is located on each of the opposite side edges of the wall structure 4. In an example embodiment, once secured to the wall structure, the spring loaded wall extensions 6 are each then moved into their retracted position as shown in FIG. 4. In their retracted positions, the wall extensions 6 are generally perpendicular to the plane of the central wall section 4, thereby decreasing the size of the wall structure 20. In example embodiments the spring loaded hinges 3 are configured to bias the wall extensions 6 into their extended positions, and accordingly, as part of the wall assembly, releasable restraining devices are used to temporarily secure the wall extensions 6 into their retracted positions. By way of example, plastic cable ties may be used as releasable restraining devices.

Figure 9:
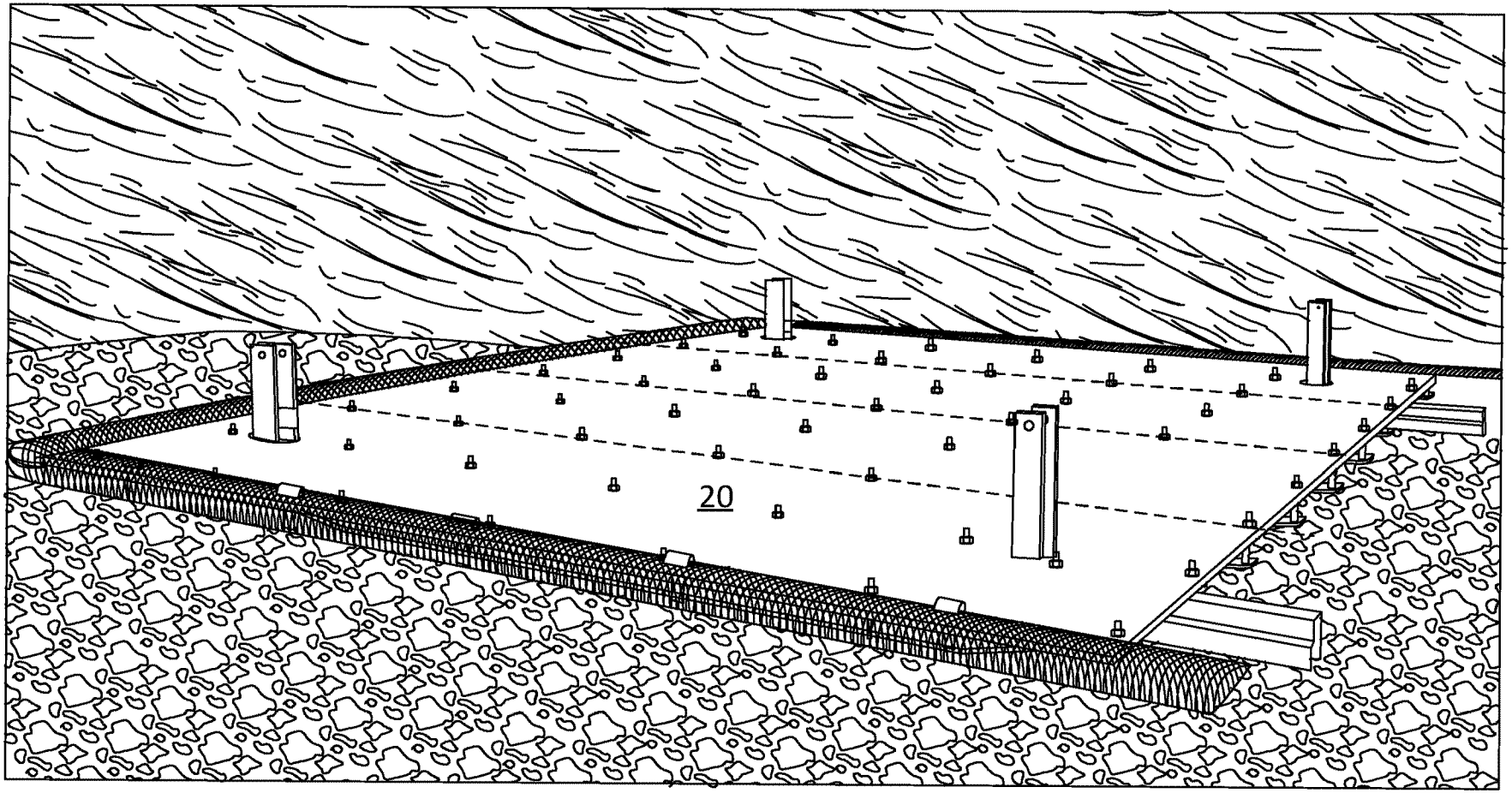
FIG. 9 shows the barricade wall assembly of FIG. 1, pre-installation, and without the beams attached, in a lowered position.

FIG. 9 illustrates an assembled wall structure 20 (excluding wire cages 40 and mesh 41) laying on its skid rails on the floor of a mine drift. In FIG. 9, the wall extensions 6 are in their extended position and have not yet been folded and secured into their retracted positions. Once the wall structure is assembled, upper and lower beams 9,5 are pivotally secured to the beam brackets 34 that extend from the wall structure 20, and can be used to maneuver and raise the wall structure 20 into its installation location, and then secure the wall structure in place. In an example embodiment, interface attachments for a forklift may be provided on beams 9,5 to allow the forklift to be used to raise the bulkhead wall structure 20 into a vertical position.

Figure 10:
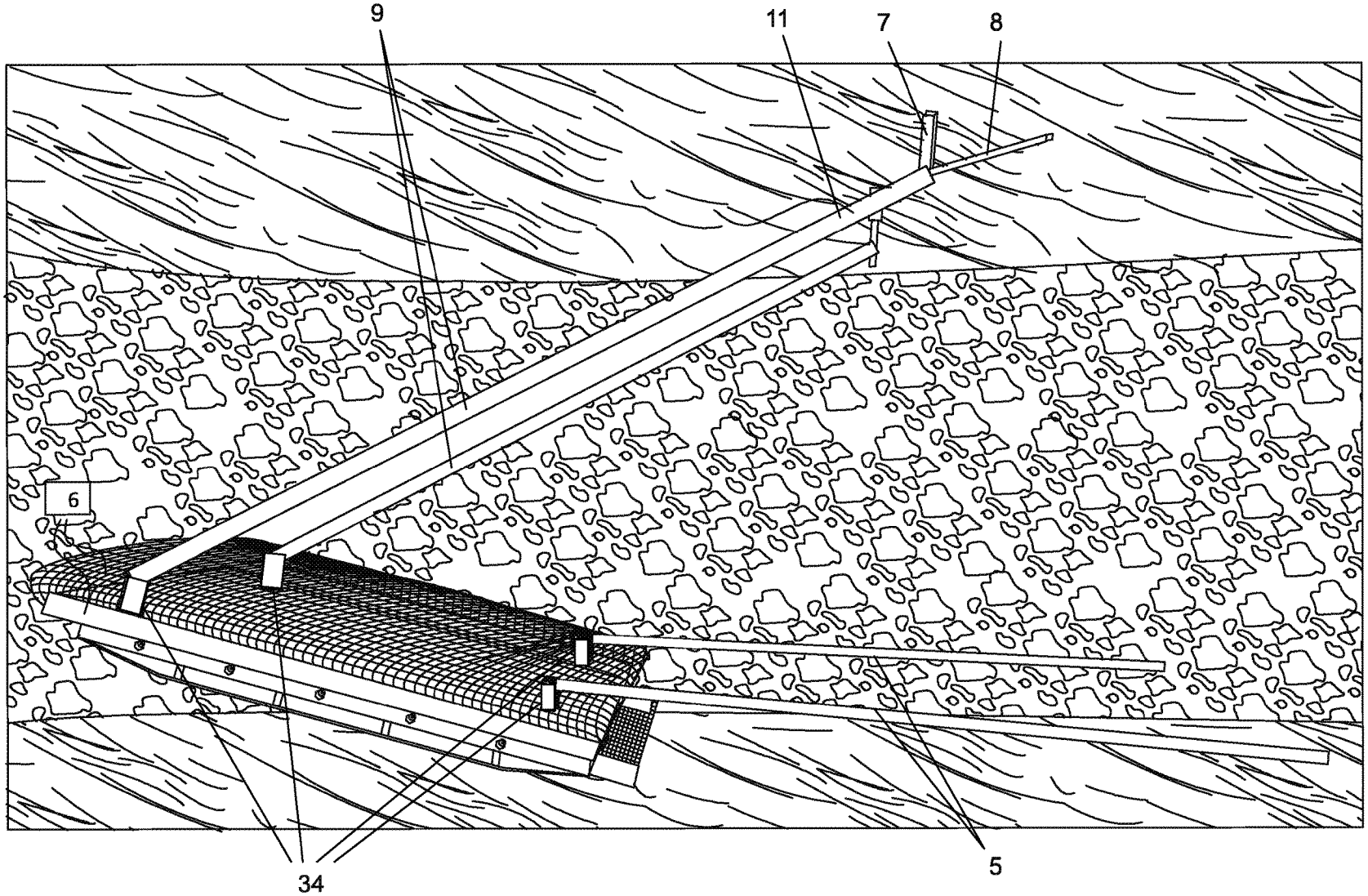
FIG. 10 shows the barricade wall assembly of FIG. 9 with the beams attached, being raised into a vertical position.

In this regard, FIG. 10 shows a partially raised wall structure 20 in which the upper and lower beams 9,5 pivotally secured to the beam brackets 34 are being used to maneuver the wall structure 20. In FIG. 10, the wall extensions 6 are in their folded, retracted positions to provide clearance between the periphery of the central wall section 4 and the drift tunnel walls and ceiling during installation.

In example embodiments, holes are pre-drilled in the ceiling of the drift tunnel and mounting brackets 7 are secured to the ceiling with bolts. The terminal brackets 28 at the upper ends of upper beams 9 are then secured by pins 10 to the secured mounting brackets 7, and the bottom of the wall structure 20 is pushed into place using bottom beams 5. If required, adjustment beam section 11 of one or more of the upper beams 9 can be removed or swapped out for a different length beam on location. Adjustment arm 8 can be secured to the ceiling and used to adjust the angle between upper beam 9 and the mounting bracket 7 to further adjust the location of wall structure 20. In example embodiments, adjustment arm 8 is also connected to adjustment beam section 11 and mounting bracket 7 via pin member 10. Adjusting arm 8 is pivoted toward the ceiling of the mine and connected to the ceiling via, for example, bolting or screwing, in order to provide additional support to barricade wall 1.

Figure 11:
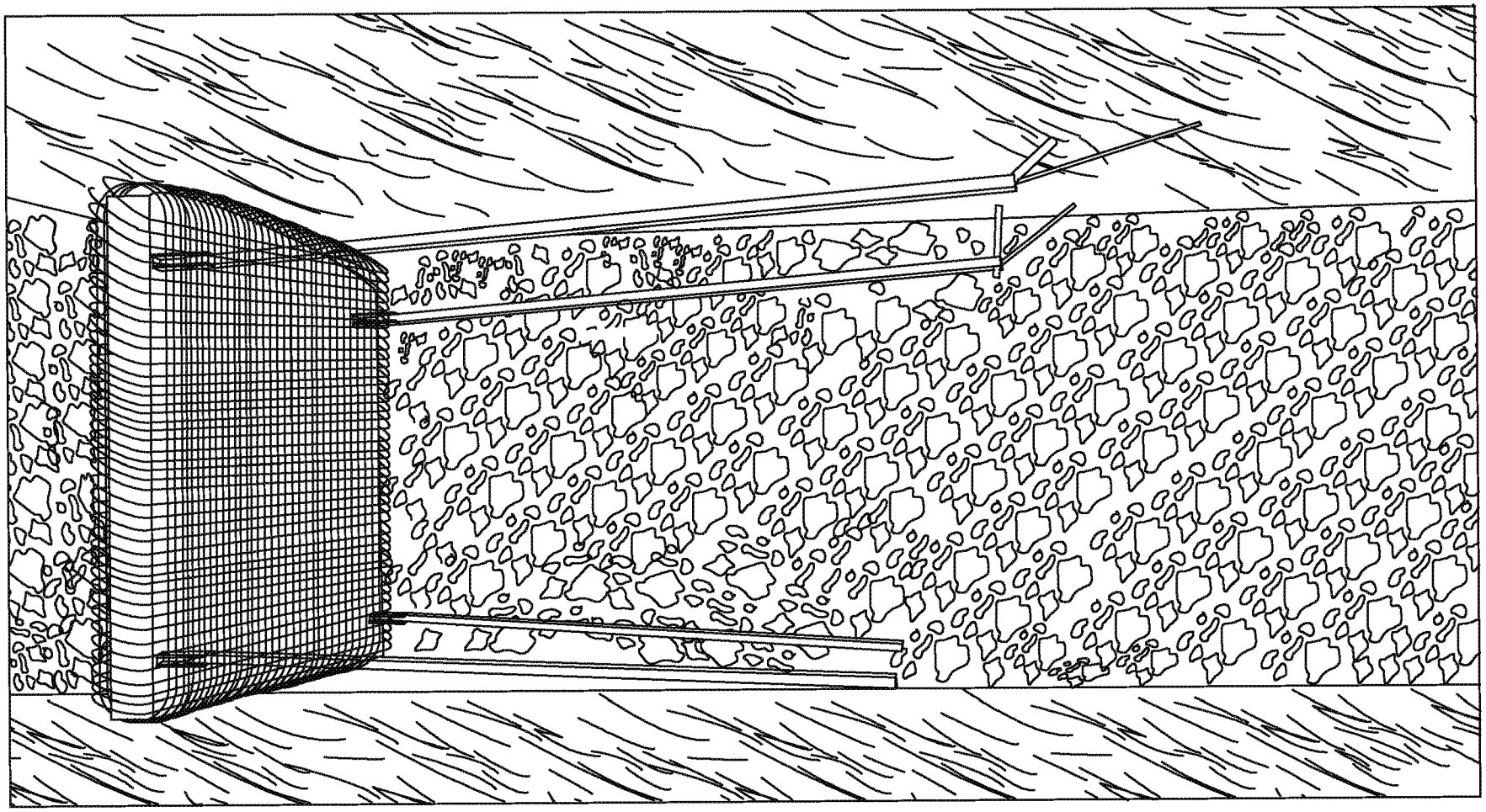
FIG. 11 shows the barricade wall assembly of FIG. 9 erected within a drift tunnel, before being coated with shotcrete, with wall extenders in an extended position.
Figure 12:
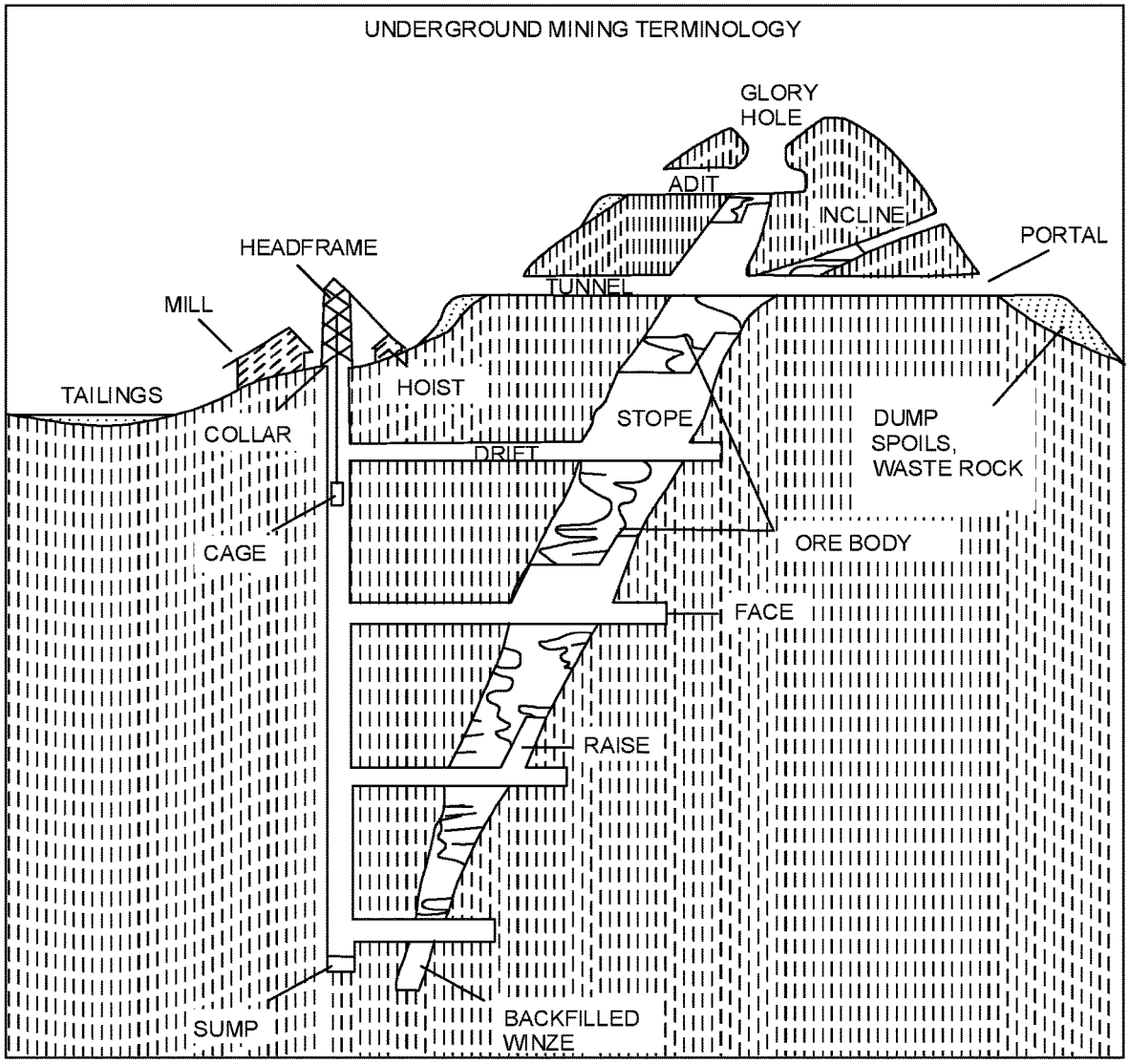
FIG. 12 is a drawing of a mine shaft and drift tunnels, illustrating an example environment in which the barricade wall assembly may be used.

FIG. 11 shows barricade wall structure 20 secured in place across an opening in a mane drift tunnel. In FIG. 11, the releasable restraining devices are used to temporarily secure the wall extensions 6 into their retracted positions have been removed (for example, restraining cable ties cut), allowing the wall extensions 6 to spring out into their extended positions and fill spaces between tunnel walls and the central rigid wall section 4. In example embodiments, the semi-rigid nature of mesh section 24 provides a varying width along the length of the wall extensions 6 allowing them to engage and conform to uneven surfaces.

Bottom beams 5 can be secured to walls or floor of the tunnel by bolting in some applications. Beams 9 and 5 allow the wall structure 20 to be moved into place and secured from a predefined safe distance. Once the wall structure 20 is secured in place, a concrete coating such as shotcrete can be applied from a safe distance to the front exposed side of central rigid wall section 4 as (the side on which mesh cages 40 and mesh layer 41 are installed), and to the surrounding wall extensions 6, providing a secure barricade wall. In some examples braces 5, 9 can be removed once the shotcrete has set.

Previous barricade wall installations were difficult to install close to the backfill area. In an example embodiment of barricade wall assembly 1, the barricade wall structure 20 can be installed 21 feet or closer to the opening of area being excavated.

Although described above in the context of a sold wall structure, in some examples a door or other passage could be included in the wall structure 20. For example, the methods and systems described above could similarly be applied to provide a bulkhead frame structure across a tunnel opening that could be used to support a door. In such examples, an opening and corresponding door could be included in central rigid wall structure 4.

Although spring loaded hinges 3 have been described above as provided the mechanism for moving spring loaded wall extensions 6 into place, in other examples other biasing elements could be used, for example spring loaded retractable piston devices.

The embodiments of the present disclosure described above are intended to be examples only. The present disclosure may be embodied in other specific forms. Alterations, modifications and variations to the disclosure may be made without departing from the intended scope of the present disclosure. While the systems, devices and processes disclosed and shown herein may comprise a specific number of elements/components, the systems, devices and assemblies could be modified to include additional or fewer of such elements/components. For example, while any of the elements/components disclosed may be referenced as being singular, the embodiments disclosed herein could be modified to include a plurality of such elements/components. Selected features from one or more of the above-described embodiments may be combined to create alternative embodiments not explicitly described. All values and subranges within disclosed ranges are also disclosed. The subject matter described herein intends to cover and embrace all suitable changes in technology.

What is claimed is:

1. A barricade wall assembly comprising:

a wall structure including:

a central wall section;

at least one wall extension located at an edge of the central wall section, the wall extension being movable between a retracted position in which a dimension of the wall structure is reduced and an extended position in which the dimension of the wall structure is increased; and at least one biasing mechanism connecting the at least one wall extension to the central wall section, the biasing mechanism spring biasing the at least one wall extension towards the extended position.

2. The barricade wall assembly of claim 1 wherein the at least one wall extension includes a peripheral semi-rigid section.

3. The barricade wall assembly of claim 2 wherein the at least one wall extension includes a rigid section that is movably connected to the central wall section, the peripheral semi-rigid section being secured to and extending from the rigid section.

4. The barricade wall assembly of claim 3 wherein the semi-rigid section is formed from a wire mesh configured to conform to an uneven surface when the wall extension is in the extended position.

5. The barricade wall assembly of claim 1 wherein the at least one biasing mechanism includes a spring loaded hinge.

6. The barricade wall assembly of claim 1 comprising a plurality of the wall extensions located at edges of the central wall section, the wall extensions each being movable between a retracted position in which a dimension of the wall structure is reduced and an extended position in which the dimension of the wall structure is increased.

7. The barricade wall assembly of claim 1 wherein the at least one wall extension extends between 4 to 12 inches from the edge of the central wall section when in the extended position.

8. The barricade wall assembly of claim 1 wherein the central wall section includes one or more rigid panels and mesh structures secured to a surface of the one or more rigid panels to receive a concrete coating.

9. The barricade wall assembly of claim 8 comprising a pair of skids on an opposite facing surface of the one or more rigid panels than the mesh structures.

10. The barricade wall assembly of claim 1 further including:

a mounting bracket having a first bracket portion configured to be secured to a support surface location and a second bracket portion pivotally mounted to the first bracket portion;

at least one support beam having first end pivotally mounted to the wall structure and a second end pivotally mounted to the second bracket portion of the mounting bracket; and an adjustment mechanism comprising an arm coupled to the second end of the at least one support beam for applying a force to adjust an angle of the at least one support beam relative to the lower bracket portion and thereby adjust a distance that the support beam extends between the support surface location and the wall structure.

11. The barricade wall assembly of claim 1 wherein the barricade wall assembly is configured for closing a tunnel passage and includes a plurality of the wall extensions secured to one or more of top and side edges of the central wall section by at least one respective biasing mechanism and movable between a retracted position and the extended position, wherein in the extended position the wall extensions cause the barricade wall structure to have a larger tunnel passage coverage area than in the retracted position.

12. The barricade wall structure of claim 11 wherein the biasing mechanisms include spring loaded hinges, and the wall extensions each include a semi-rigid peripheral section for conforming to a surface of the tunnel passage.

13. A method of installing a barricade wall structure in a passageway, wherein the barricade wall structure includes a plurality of wall extensions secured to one or more of top and side edges of the central wall section, the wall extensions each being movable between a retracted position and an extended position and being spring biased towards the extended position, wherein in the extended position the wall extensions cause the barricade wall structure to have a larger coverage area than in the retracted position, the method comprising:

restraining the wall extensions into their respective retracted positions against the spring biasing;

positioning the barricade wall structure, with the wall extensions in the retracted position, at least partially across the passageway; and after positioning the barricade wall structure, releasing the wall extensions from their respective retracted positions to cause the wall extensions to move under force of the spring biasing to the extended position so that the barricade wall structure extends further across the passageway than when the wall extensions were in the retracted position.

14. The method of claim 13 further comprising applying a concrete layer to central wall section and the wall extensions to block the passageway.

15. The method of claim 13 wherein positioning the barricade wall structure comprises securing a first end of a support beam to the barricade wall structure and securing a second end of the support beam to a surface of a ceiling or wall of the passageway with a mounting bracket and adjusting an angle of the support beam relative to the mounting bracket to adjust a location of the barricade wall structure.

16. The method of claim 15 wherein an adjustment arm that is pivotally connected to the mounting bracket is used to adjust the angle, the method further including securing an end of the adjustment arm to the ceiling or wall of the passageway.

17. The method of claim 13 where the wall extensions are secured to the central wall section by spring loaded hinges, wherein releasing the wall extensions comprises enabling the spring loaded hinges to move the wall extensions to the extended position.

18. A barricade wall assembly comprising:

a wall structure including:

a central wall section including one or more rigid panels and mesh structures secured to a surface of the one or more rigid panels to receive a concrete coating, and a pair of skids on an opposite facing surface of the one or more rigid panels than the mesh structures;

at least one wall extension located at an edge of the central wall section, the wall extension being movable between a retracted position in which a dimension of the wall structure is reduced and an extended position in which the dimension of the wall structure is increased.

* * * * *